US008616152B2

(12) United States Patent
Chen

(10) Patent No.: US 8,616,152 B2
(45) Date of Patent: Dec. 31, 2013

(54) STENT COATING APPARATUS

(75) Inventor: Yung Ming Chen, San Jose, CA (US)

(73) Assignee: Abbott Cardiovascular Systems Inc., Santa Clara, CA (US)

( * ) Notice: Subject to any disclaimer, the term of this patent is extended or adjusted under 35 U.S.C. 154(b) by 0 days.

(21) Appl. No.: 13/567,920

(22) Filed: Aug. 6, 2012

(65) Prior Publication Data

US 2012/0291703 A1 Nov. 22, 2012

Related U.S. Application Data

(60) Continuation of application No. 12/840,178, filed on Jul. 20, 2010, now Pat. No. 8,236,369, which is a division of application No. 11/442,005, filed on May 26, 2006, now Pat. No. 7,775,178.

(51) Int. Cl.

| | |
|---|---|
| ***B05C 19/06*** | (2006.01) |
| ***B05C 19/04*** | (2006.01) |
| ***B05C 19/00*** | (2006.01) |
| ***B05C 5/02*** | (2006.01) |
| ***B05C 5/00*** | (2006.01) |
| ***B05C 11/08*** | (2006.01) |
| ***B05C 11/02*** | (2006.01) |
| ***B05C 11/10*** | (2006.01) |
| ***B05C 11/00*** | (2006.01) |

(52) U.S. Cl.

USPC ..... 118/699; 118/696; 118/320; 118/315; 118/313; 118/300

(58) Field of Classification Search

None

See application file for complete search history.

(56) References Cited

U.S. PATENT DOCUMENTS

| | | | | | |
|---|---|---|---|---|---|
| 4,697,195 | A | * | 9/1987 | Quate et al. | 347/46 |
| 5,722,479 | A | | 3/1998 | Oeftering | |
| 5,824,049 | A | * | 10/1998 | Ragheb et al. | 623/1.44 |
| 5,837,313 | A | * | 11/1998 | Ding et al. | 427/2.21 |
| 5,898,446 | A | * | 4/1999 | Moriyama | 347/46 |
| 6,096,070 | A | * | 8/2000 | Ragheb et al. | 623/1.39 |
| 6,153,252 | A | * | 11/2000 | Hossainy et al. | 427/2.3 |
| 6,217,151 | B1 | | 4/2001 | Young | |
| 6,231,600 | B1 | * | 5/2001 | Zhong | 623/1.42 |
| 6,258,121 | B1 | * | 7/2001 | Yang et al. | 623/1.46 |
| 6,284,305 | B1 | * | 9/2001 | Ding et al. | 427/2.28 |
| 6,287,628 | B1 | * | 9/2001 | Hossainy et al. | 427/2.3 |
| 6,299,604 | B1 | * | 10/2001 | Ragheb et al. | 604/265 |

(Continued)

FOREIGN PATENT DOCUMENTS

| | | |
|---|---|---|
| EP | 0 586 187 | 3/1994 |
| EP | 0 728 584 | 8/1996 |
| EP | 1 364 628 | 11/2003 |
| WO | WO 2004/012784 | 2/2004 |

OTHER PUBLICATIONS

International Search Report for PCT/US2006/015541, filed Apr. 18, 2006, mailed Jun. 29, 2007, 18 pgs.

(Continued)

*Primary Examiner* — Dah-Wei Yuan
*Assistant Examiner* — Jethro Pence
(74) *Attorney, Agent, or Firm* — Squire Sanders (US) LLP

(57) ABSTRACT

An apparatus for coating a stent comprises a coating solution reservoir, a stent support for carrying a stent adjacent the reservoir, transducers for generating waves through the coating solution, and a controller that controls timing at which the transducers are powered in order to eject a droplet of the coating solution.

11 Claims, 7 Drawing Sheets

(56) References Cited

U.S. PATENT DOCUMENTS

| | | | | |
|---|---|---|---|---|
| 6,358,556 | B1 * | 3/2002 | Ding et al. | 427/2.24 |
| 6,395,326 | B1 * | 5/2002 | Castro et al. | 427/2.24 |
| 6,451,373 | B1 * | 9/2002 | Hossainy et al. | 427/2.25 |
| 6,503,556 | B2 * | 1/2003 | Harish et al. | 427/2.24 |
| 6,527,863 | B1 * | 3/2003 | Pacetti et al. | 118/500 |
| 6,544,582 | B1 * | 4/2003 | Yoe | 427/2.24 |
| 6,555,157 | B1 * | 4/2003 | Hossainy | 427/2.24 |
| 6,565,659 | B1 * | 5/2003 | Pacetti et al. | 118/500 |
| 6,572,644 | B1 * | 6/2003 | Moein | 623/1.11 |
| 6,585,765 | B1 * | 7/2003 | Hossainy et al. | 623/1.45 |
| 6,596,239 | B2 | 7/2003 | Williams et al. | |
| 6,605,154 | B1 * | 8/2003 | Villareal | 118/500 |
| 6,613,432 | B2 * | 9/2003 | Zamora et al. | 428/409 |
| 6,616,765 | B1 * | 9/2003 | Wu et al. | 118/669 |
| 6,645,547 | B1 * | 11/2003 | Shekalim et al. | 427/2.24 |
| 6,666,880 | B1 * | 12/2003 | Chiu et al. | 623/1.11 |
| 6,673,154 | B1 * | 1/2004 | Pacetti et al. | 118/500 |
| 6,676,987 | B2 * | 1/2004 | Zhong et al. | 427/2.24 |
| 6,695,920 | B1 * | 2/2004 | Pacetti et al. | 118/500 |
| 6,709,514 | B1 * | 3/2004 | Hossainy | 118/52 |
| 6,712,845 | B2 * | 3/2004 | Hossainy | 623/1.42 |
| 6,713,119 | B2 * | 3/2004 | Hossainy et al. | 427/2.25 |
| 6,716,444 | B1 * | 4/2004 | Castro et al. | 424/422 |
| 6,743,462 | B1 * | 6/2004 | Pacetti | 427/2.24 |
| 6,790,228 | B2 * | 9/2004 | Hossainy et al. | 623/1.46 |
| 6,861,008 | B1 * | 3/2005 | De Steur et al. | 216/94 |
| 6,867,248 | B1 | 3/2005 | Martin et al. | |
| 6,916,379 | B2 * | 7/2005 | Shekalim et al. | 118/669 |
| 6,971,813 | B2 * | 12/2005 | Shekalim et al. | 401/208 |
| 7,048,962 | B2 * | 5/2006 | Shekalim et al. | 427/2.24 |
| 7,208,190 | B2 | 4/2007 | Verlee | |
| 7,214,759 | B2 * | 5/2007 | Pacetti et al. | 528/190 |
| 7,323,210 | B2 | 1/2008 | Castro et al. | |
| 7,342,670 | B2 | 3/2008 | Teichman | |
| 7,344,599 | B2 * | 3/2008 | Shekalim et al. | 118/264 |
| 7,416,609 | B1 | 8/2008 | Madriaga et al. | |
| 7,455,876 | B2 | 11/2008 | Castro et al. | |
| 7,599,727 | B2 | 10/2009 | Teichman | |
| 7,775,178 | B2 | 8/2010 | Chen | |
| 7,976,891 | B1 | 7/2011 | Van Sciver et al. | |
| 8,236,369 | B2 | 8/2012 | Chen | |
| 2001/0037145 | A1 * | 11/2001 | Guruwaiya et al. | 623/1.15 |
| 2002/0051730 | A1 * | 5/2002 | Bodnar et al. | 422/33 |
| 2002/0126166 | A1 | 9/2002 | Ellson | |
| 2002/0188037 | A1 * | 12/2002 | Chudzik et al. | 523/112 |
| 2003/0036794 | A1 * | 2/2003 | Ragheb et al. | 623/1.15 |
| 2003/0040790 | A1 * | 2/2003 | Furst | 623/1.11 |
| 2003/0059520 | A1 * | 3/2003 | Chen et al. | 427/2.1 |
| 2003/0065377 | A1 * | 4/2003 | Davila et al. | 623/1.13 |
| 2003/0072868 | A1 * | 4/2003 | Harish et al. | 427/2.24 |
| 2003/0113439 | A1 * | 6/2003 | Pacetti et al. | 427/2.24 |
| 2003/0157241 | A1 * | 8/2003 | Hossainy et al. | 427/2.24 |
| 2003/0190406 | A1 * | 10/2003 | Hossainy et al. | 427/2.25 |
| 2003/0207020 | A1 * | 11/2003 | Villareal | 427/2.24 |
| 2003/0211230 | A1 * | 11/2003 | Pacetti et al. | 427/2.24 |
| 2004/0018296 | A1 * | 1/2004 | Castro et al. | 427/2.25 |
| 2004/0047978 | A1 * | 3/2004 | Hossainy et al. | 427/2.1 |
| 2004/0053381 | A1 | 3/2004 | Williams et al. | |
| 2004/0060508 | A1 * | 4/2004 | Pacetti et al. | 118/264 |
| 2004/0062853 | A1 * | 4/2004 | Pacetti et al. | 427/2.1 |
| 2004/0063805 | A1 * | 4/2004 | Pacetti et al. | 523/113 |
| 2004/0068316 | A1 | 4/2004 | Schaeffer | |
| 2004/0071861 | A1 * | 4/2004 | Mandrusov et al. | 427/2.24 |
| 2004/0073298 | A1 * | 4/2004 | Hossainy | 623/1.46 |
| 2004/0076747 | A1 * | 4/2004 | Shekalim et al. | 427/162 |
| 2004/0086542 | A1 * | 5/2004 | Hossainy et al. | 424/423 |
| 2004/0117007 | A1 | 6/2004 | Whitbourne et al. | |
| 2004/0185081 | A1 | 9/2004 | Verlee et al. | |
| 2004/0189748 | A1 * | 9/2004 | Amemiya | 347/46 |
| 2004/0202773 | A1 * | 10/2004 | Verlee et al. | 427/2.1 |
| 2004/0254634 | A1 | 12/2004 | Verlee et al. | |
| 2005/0048194 | A1 * | 3/2005 | Shmulewitz | 427/2.24 |
| 2005/0049694 | A1 * | 3/2005 | Neary | 623/1.46 |
| 2005/0058768 | A1 * | 3/2005 | Teichman | 427/2.24 |
| 2005/0064088 | A1 * | 3/2005 | Fredrickson | 427/2.24 |
| 2005/0079274 | A1 * | 4/2005 | Palasis et al. | 427/2.1 |
| 2005/0241577 | A1 * | 11/2005 | Shekalim et al. | 118/669 |
| 2006/0073265 | A1 * | 4/2006 | Teichman et al. | 427/2.1 |
| 2006/0136048 | A1 | 6/2006 | Pacetti et al. | |
| 2006/0156976 | A1 | 7/2006 | Shekalim et al. | |
| 2006/0172060 | A1 | 8/2006 | Teichman et al. | |
| 2006/0217801 | A1 | 9/2006 | Rosenthal | |
| 2006/0233942 | A1 | 10/2006 | Shekalim | |
| 2008/0003349 | A1 | 1/2008 | Van Sciver et al. | |
| 2008/0206442 | A1 | 8/2008 | Shekalim et al. | |
| 2008/0220174 | A1 | 9/2008 | Teichman | |
| 2008/0226812 | A1 | 9/2008 | Chen | |
| 2009/0232964 | A1 | 9/2009 | Chen | |

OTHER PUBLICATIONS

Pouton et al., "Biosynthetic polyhydroxyalkanoates and their potential in drug delivery", Advanced Drug Delivery Reviews 18, pp. 133-162 (1996).

International Search Report for PCT/US2007/009113 filed Apr. 13, 2007, mailed Sep. 28, 2007, 15 pgs.

Elrod et al., "Nozzleless droplet formation with focused acoustic beams", J. of Applied Physics 65, No. 9, pp. 3441-3447 (1989).

* cited by examiner

Figure 3-Schematic diagram of a transducer assembly (50)

STENT COATING APPARATUS

CROSS-REFERENCE TO RELATED APPLICATIONS

This application is a continuation of application Ser. No. 12/840,178, filed Jul. 20, 2010, now U.S. Pat. No. 8,236,369, which is a divisional of application Ser. No. 11/442,005, filed May 26, 2006, now U.S. Pat. No. 7,775,178, both of which applications are incorporated herein by reference.

FIELD OF THE INVENTION

The present invention relates an apparatus for coating a stent.

BACKGROUND

Percutaneous transluminal coronary angioplasty (PTCA) has revolutionized the treatment of coronary arterial disease. A PTCA procedure involves the insertion of a catheter into a coronary artery to position an angioplasty balloon at the site of a stenotic lesion that is at least partially blocking the coronary artery. The balloon is then inflated to compress against the stenosis and to widen the lumen to allow an efficient flow of blood through the coronary artery. However, restenosis at the site of angioplasty continues to hamper the long term success of PTCA, with the result that a significant proportion of patients have to undergo repeated revascularization.

Stenting has been shown to significantly reduce the incidence of restenosis to about 20 to 30%. On the other hand, the era of stenting has brought a new problem of in-stent restenosis. As shown in FIG. 1, a stent 2 is a scaffolding device for the blood vessel and it typically has a cylindrical configuration and includes a number of interconnected struts 4. The stent is delivered to the stenosed lesion through a balloon catheter. Stent is expanded to against the vessel walls by inflating the balloon and the expanded stent can hold the vessel open.

Stent can be used as a platform for delivering pharmaceutical agents locally. The inherent advantage of local delivery the drug over systematic administration lies in the ability to precisely deliver a much lower dose of the drug to the target area thus achieving high tissue concentration while minimizing the risk of systemic toxicity.

Given the dramatic reduction in restenosis observed in these major clinical trials, it has triggered the rapid and widespread adoption of drug-eluting stents (DES) in many countries. A DES consisting of three key components, as follows: (1) a stent with catheter based deployment device, (2) a carrier that permits eluting of the drug into the blood vessel wall at the required concentration and kinetic profile, and (3) a pharmaceutical agent that can mitigate the in-stent restenosis. Most current DES systems utilize current-generation commercial stents and balloon catheter delivery systems.

The current understanding of the mechanism of restenosis suggests that the primary contributor to re-narrowing is the proliferation and migration of the smooth muscle cells from the injured artery wall into the lumen of the stent. Therefore, potential drug candidates may include agents that inhibit cell proliferation and migration, as well as drugs that inhibit inflammation. Utilizing the synergistic benefits of combination therapy (drug combination) has started the next wave of DES technology.

Strict pharmacologic and mechanical requirements must be fulfilled in designing the drug-eluting stents (DES) to guarantee drug release in a predictable and controlled fashion over a time period. In addition, a high speed coating apparatus that can precisely deliver a controllable amount of pharmaceutical agents onto the selective areas of the abluminal surface of a stent is extremely important to the DES manufactures.

There are several conventional coating methods have been used to apply the drug onto a stent, e.g. by dipping the stent in a coating solution containing a drug or by spraying the drug solution onto the stent. Dipping or spraying usually results in a complete coverage of all stent surfaces, i.e., both luminal and abluminal surfaces. The luminal side coating on a coated stent can have negative impacts to the stent's deliverability as well as the coating integrity. Moreover, the drug on the inner surface of the stent typically provides for an insignificant therapeutic effect and it get washed away by the blood flow. While the coating on the abluminal surface of the stent provides for the delivery of the drug directly to the diseased tissues.

The coating in the lumen side may increase the friction coefficient of the stent's surface, making withdrawal of a deflated balloon more difficult. Depending on the coating material, the coating may adhere to the balloon as well. Thus, the coating may be damaged during the balloon inflation/deflation cycle, or during the withdrawal of the balloon, resulting in a thrombogenic stent surface or embolic debris.

Defect formation on the stents is another shortcoming caused by the dipping and spraying methods. For example, these methods cause webbing, pooling, or clump between adjacent stent struts of the stent, making it difficult to control the amount of drug coated on the stent. In addition, fixturing (e.g. a mandrel) used to hold the stent in the spraying method may also induce coating defects. For example, upon the separation of the coated stent from the mandrel, it may leave some excessive coating material attached to the stent, or create some uncoated areas at the interface between the stent struts and mandrel. The coating weight and drop size uniformity control is another challenge of using aforementioned methods.

Another coating method involves the use of inkjet or bubble-jet technology. The drop ejection is generated by the physical vibration through a piezoelectric actuation or by thermal actuation. In an example, single inkjet or bubble-jet nozzle head can be devised as an apparatus to precisely deliver a controlled volume coating substance to the entire or selected struts over a stent, thus it mitigates some of the shortcomings associated with the dipping and spraying methods. Typically, this operation involves moving an ejector head along the struts of a stent to be coated, but its coating speed is inherently much slower than, for example, an array coating system which consists of many transducers and each transducer can generate droplets to coat a stent simultaneously. This coating apparatus enables to generate droplets at single or multiple locations simultaneously on demand, thus it allows to coat stent in a much faster and versatile way (e.g. line printing rather than dot printing).

Furthermore, nozzle clogging, which may adversely affect coating quality, is a common problem to spraying, inkjet, and bubble-jet methods. Cleaning the nozzles results in a substantial downtime, decreased productivity, and increased maintenance cost.

It has been shown that focused and high intensity sound beams can be used for ejecting droplets. It is based on a constructive interference of acoustic waves—the acoustic waves will add in-phase at the focal point. Droplet formation using a focused acoustic beam is capable of ejecting liquid drop as small as a few microns in diameter with good reliability. It typically requires an acoustic lens to focus the acoustic waves.

The present invention addresses the aforementioned shortcomings from the conventional coating methods.

SUMMARY

Briefly and in general terms, the present invention is directed an apparatus for coating a stent.

In some aspects of the invention, an apparatus comprises a reservoir configured to carry a coating solution, a stent support configured to carry a stent adjacent the reservoir, a plurality of transducers coupled to the reservoir, and a controller. Each transducer is configured to generate a wave through the coating solution to be carried in the reservoir. The controller is configured to power a first subset of transducers from among the plurality of transducers to eject a first droplet of the coating solution from a first ejection point on a surface of the coating solution, and is configured to power a second subset of transducers from among the plurality of transducers to eject a second droplet from a second ejection point on the surface of the coating solution, the second ejection point being different in location from the first ejection point.

In some aspects of the invention, an apparatus comprises a reservoir configured to carry a coating solution, a stent support configured to carry a stent adjacent the reservoir, transducers coupled to the reservoir, and a controller. Each transducer is configured to generate a wave through the coating solution to be carried in the reservoir. The controller is configured to control timing at which the transducers are powered to produce constructively interfering waves, from a first subset of the transducers, that eject a first droplet from a first ejection point at a surface of the coating solution.

The features and advantages of the invention will be more readily understood from the following detailed description which should be read in conjunction with the accompanying drawings.

DETAILED DESCRIPTION OF PREFERRED EMBODIMENTS

Figure 1:
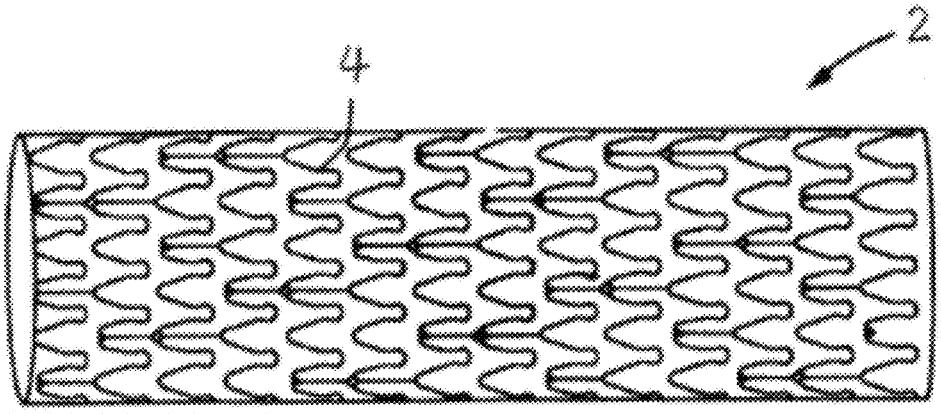
FIG. 1 Prior Art
FIG. 1 is a drawing to show a typical stent design.
Figure 2:
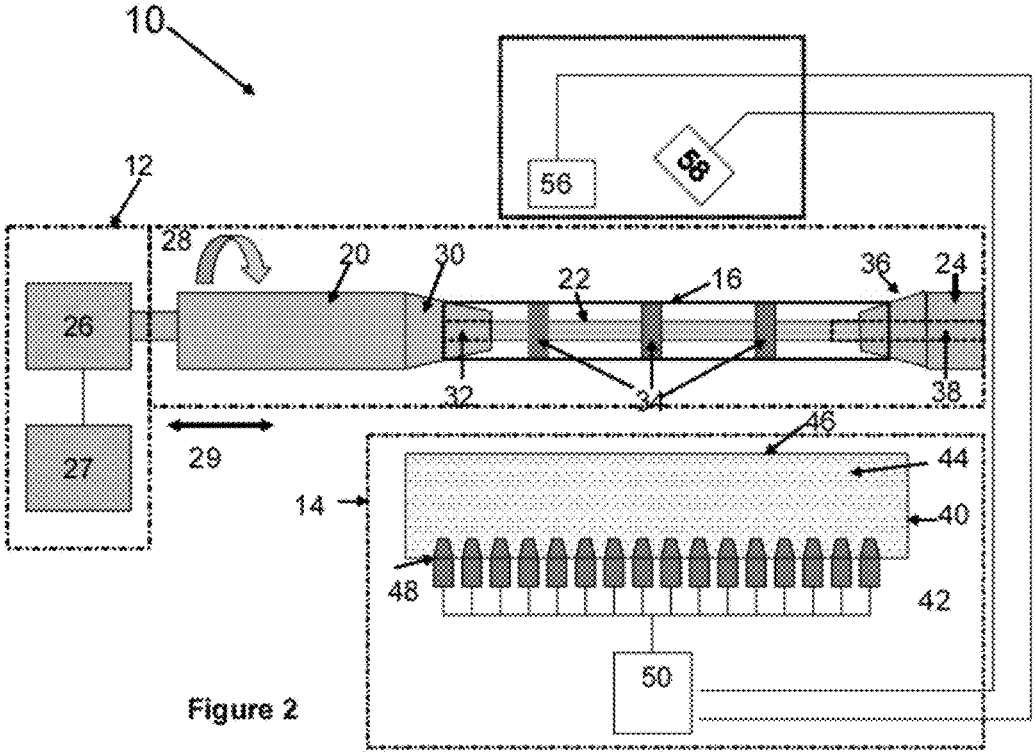
FIG. 2 is a schematic view of a stent coating apparatus according to an embodiment of the present invention.

FIG. 2 illustrates a stent coating apparatus 10. The apparatus 10 includes a stent handling 12, a coating device 14, and an imaging system, 56 and 58. The stent handling system 12 is to provide the supports to a stent 16 which is connected to motor 26 and motor 27 so as to control stent's circumferential and translational movements. The coating device 14 applies a coating to the stent 16.

In the embodiment shown in FIG. 2, the stent support 12 includes a shaft 20, a mandrel 22, and an optional lock member 24. The lock member 24 is optional if the mandrel 22 by itself can support the stent 16. The support member 20 is connected to a motor 26 to rotate the stent in the circumferential direction, so as motor 27 to translate the stent in the longitudinal direction of the stent 16, as depicted by the arrows 28 and 29.

In this embodiment, the support member 20 includes a conical end portion 30 and a bore 32 for receiving a first end of the mandrel 22. The first end can be threaded to screw into the bore 32 or can be retained within the bore 32 by a friction fit. The bore 32 should be deep enough to allow the mandrel 22 to mate securely with the support member 20. The depth of the bore 32 can also be further extended to allow a significant length of the mandrel 22 to penetrate or screw into the bore 32. The bore 32 can also extend completely through the support member 20. This would allow the length of the mandrel 22 to be adjusted to accommodate stents of various sizes. The mandrel 22 may also include a plurality of ridges 34 that add rigidity to and support to the stent 16 during coating. The ridges 34 may have a diameter of slightly less than the inner diameter of the stent 16. While three ridges 34 are shown, it will be appreciated by one of ordinary skill in the art that additional, fewer, or no ridges may be present, and the ridges may be evenly or unevenly spaced.

The lock member 24 also may include a conical end portion 36. A second end of the mandrel 22 can be permanently affixed to the lock member 24 if the first end is disengageable from the support member 20. Alternatively, the mandrel 22 can have a threaded second end for screwing into a bore 38 of the lock member 24. The bore 38 can be of any suitable depth that would provide the lock member 24 incremental movement with respect to the support member 20. The bore 38 on the lock member 24 can also be made as a through hole. Accordingly, stents of any length can be secured between the support member 20 and the lock members 20 and 24. In accordance with this embodiment, the second end lock member 24 contains a through hole 38 enabling the second end lock member to slide over the mandrel 22 to keep the stent 16 on the mandrel 22.

The coating device 14 shown in FIG. 2 includes a reservoir 40 and a transducer assembly 42. The reservoir 40 is used to hold a coating substance 44 to be applied to the stent 16. The transducer assembly 42 is submerged in the reservoir 40. The transducer assembly 42 generates acoustic energy to eject droplets from the surface 46 of the coating solution 44 to coat the stent 16. Preferably, the locations of the ejection points on the surface 46 of the coating substance 44 are matched to the stent strut areas that need to be coated.

The reservoir 40 may have any suitable configuration and may be disposed at any suitable location. For example, the reservoir 40 may have a cylindrical, elliptical or parallelepiped configuration. Preferably, the reservoir 40 encompasses the entire stent 16 so that droplets ejected from the surface 46 can reach all areas of the stent 16. Alternatively, the reservoir 40 may cover only an area of the stent to be coated. In a preferred embodiment, the reservoir 40 is positioned directly underneath the stent. Also, a short distance between the stent and the surface of reservoir 46 is maintained to ensure a stable droplet ejection.

Figure 3:
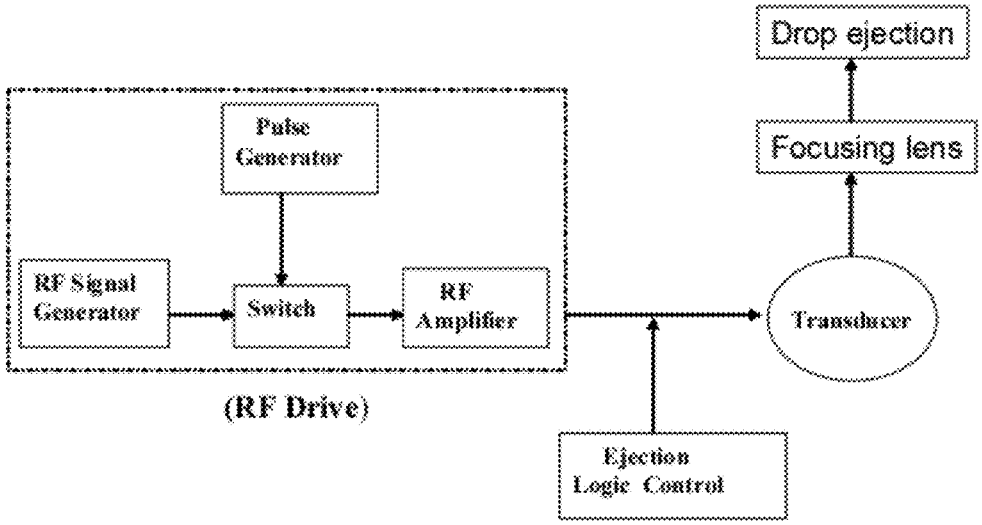
FIG. 3 is a schematic diagram of a transducer assembly.

As shown in FIG. 2, the transducer assembly 42 includes a plurality of transducers 48 and a controller 50 that is programmed to control the transducers 48. Each transducer 48 is used to generate the acoustic energy in the form of sound or ultrasound waves. Each transducer 48 preferably is a piezoelectric device, although it can be any other device suitable for generating ultrasound waves. The use of focused acoustic beam to eject droplets of controlled diameter and velocity from a free-liquid surface are well known in the art. FIG. 3 is a schematic diagram to show the mechanism of generating the droplet on demand using transducer arrays.

The controller 50 may be used to control the frequency, amplitude, and phase of the waves generated by each transducer 48 and to turn on or off the power supplied to the transducer 48. To generate a droplet at a predetermined point on the surface 46, the controller 50 controls the transducers 48 to generate waves that constructively interfere at this predetermined point. The focused acoustic energy causes a droplet to be ejected from the surface 46 of the coating substance 44 to coat the stent 16. Adjusting the frequency and amplitude of the ultrasound waves allows control over the ejection speed and volume of the droplet.

Figure 4:
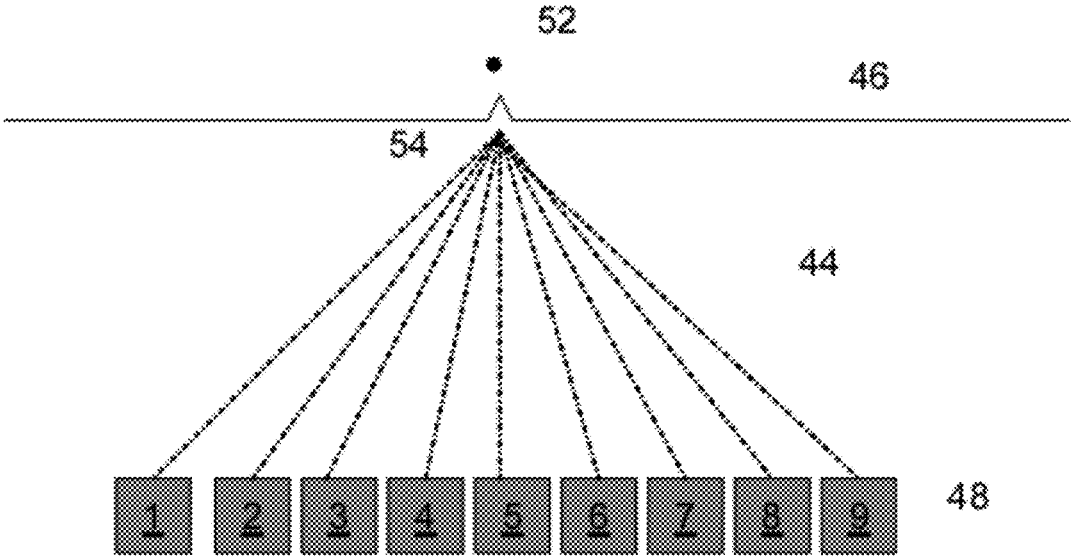
FIG. 4 is an example of generating single droplet using a transducer array according to an embodiment of the present invention.

FIG. 4 depicts the mechanism of generating a droplet from the surface of a coating substance. As illustrated in FIG. 4, a coating substance 44 is contained in a reservoir (not shown); also, there are nine transducers 48 submerged in the coating substance 44. The transducers 48 are used to generate focused in-phase waves at a predetermined ejection point 54 on the surface 46 of the coating substance 44. In other words, the waves are coherently constructed (in phase) at the ejection point (focal point) 54. The focused (through the acoustic lens) acoustic energy creates the required pressure at the ejection point 54, to eject a droplet 52 from the surface 46 onto the stent surface. In order for the waves to arrive at the ejection point 54 in phase, the transducers 48 should generate the waves at different times. In the example shown in FIG. 4, each of the first and ninth transducers, which are farthest from the ejection point 54, should first generate a wave. The fifth transducer, which is the closest to the ejection point 54, is the last to generate a wave. The precise timing for progressively generating the waves can be determined by a person of ordinary skill in the art and will not be discussed herein.

According to the present embodiment, as illustrated in FIG. 2, stent 16 is coated line by line as the stent rotates. The droplet ejection is controlled in a linear fashion and the droplet is generated only in the section that stent strut is detected. Preferably, these ejection points are aligned to stent's longitudinal direction, and the coating substance is received only on the stent's outside surfaces. The ejection points are determined through the image controllers to verify if a stent strut is present. Thus, the ejection can be excited accordingly. Excitation of drops can start from one end and ending at the other end, or the droplets can be fired in segment or in all.

The droplet formation can be generated by a single or combination of any number of transducers 48 in the reservoir 40. In some embodiments, the number of transducers used to generate each droplet may be seven. For example, the first droplet may be generated by transducers Nos. 1 to 7, the second droplet by Nos. 2 to 8, the third droplet by Nos. 3 to 9, . . . and so on. In some other embodiments, the number of transducers for generating a droplet may vary from droplet to droplet. For example, the first droplet may be generated by nine transducers, the second droplet by five, the third droplet by 15, . . . and so on. Preferably, the transducers used to generate a droplet are symmetrically arranged about the ejection point from which the droplet is ejected. Non-symmetrically arranged transducers tend to eject a droplet in a direction oblique to the surface of the coating substance. But one of ordinary skill in the art recognizes that an asymmetrical arrangement of the transducers can also be utilized to generate any specific ejection patterns by adjusting the timing, amplitude, or frequency of waves.

One preferred embodiment as shown in FIG. 2, the transducers 48 are arranged linearly and evenly spaced. In general, however, the transducer array can be arranged in any suitable manner. For example, instead of being arranged in a single row as shown in FIG. 2, the transducers may be arranged in two or multiple parallel rows. Additionally, the total required number of transducers 48 included in the transducer assembly 42 can vary depending on the application. For example, the number of transducers may range from 5 to 10,000, from 10 to 2,000, from 20 to 1,000, from 30 to 600, or from 40 to 400.

Figure 5:
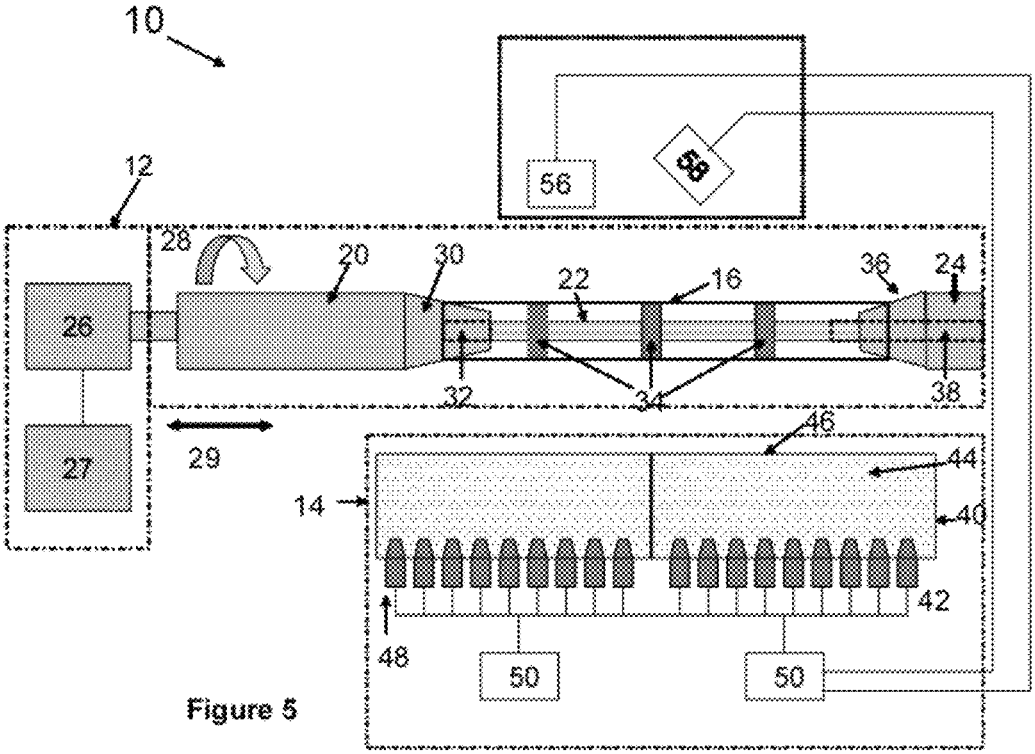
FIG. 5 is a schematic view of a stent coating apparatus includes more than one coating device.

The stent coating apparatus 10 shown in FIG. 2 is used to illustrate an example of using only one coating device 14 to coat the stent. This apparatus can be easily expanded to contain a dual-reservoir or multiple-reservoir coating system that will allow to accelerate the coating speed or it will allow to apply different formulations onto a stent. For example, as shown in FIG. 5, a stent coating apparatus 110 includes two coating assemblies 114*a* and 114*b* that are laterally arranged next to each other. Each assembly may contain different therapeutic agent. The therapeutic agent can be applied over the stent in sequence (i.e. layer by layer) to achieve a synergist effect. For example, the first coating assembly 114*a* is used to apply a layer of drug A over the stent 16, while the second assembly 114*b* is used to apply another layer of drug B on top of drug A layer.

As illustrated in FIG. 2, the stent coating apparatus 10 may include a first vision device 56 that images the stent 16 before or after the coating substance 44 has been applied to the stent 16. The first imaging device 56, along with a second imaging device 58 located a distance from the stent 16, are both communicatively coupled to the controller 50 of the transducer assembly 42. Based on the image provided by the imaging devices 56, 58, the controller 50 actuates the ejection of the droplets to coat only selected areas of the stent 16 accordingly.

After a section of the stent 16 has been coated, the coating device 14 may be stopped from dispensing the coating substance, and the imaging device 56 may begin to image the stent section to determine if the section has been adequately coated. This determination can be made by measuring the difference in color or reflectivity of the stent section before and after the coating process. If the stent section has been adequately coated, the stent coating apparatus 10 will begin to coat a new section of the stent 16. If the stent section is not coated adequately, then the stent coating apparatus 10 will recoat the stent section.

In an embodiment of the invention, the imaging devices 56, 58 can include charge coupled devices (CCDs) or complementary metal oxide semiconductor (CMOS) devices. In an embodiment of the invention, the imaging devices can be combined into a single imaging device. Further, it will be appreciated by one of ordinary skill in the art that placement of the imaging devices 56, 58 can vary as long as the devices have an acceptable view of the stent 16.

During the operation of the stent coating apparatus 10 illustrated in FIG. 2, the stent 16 is first mounted on the mandrel 22 of the stent support 12. The stent 16 is then rotated about its longitudinal axis by the motor 26 of the stent support 12. Once the stent 16 starts to rotate, the controller 50 of the coating device 14 commands the transducers 48 to generate in phase acoustic waves at one or more predetermined ejection points on the surface 46. Droplets are ejected at the focal points and get dispensed onto the stent 16. Additionally, the droplet volume can be tuned by adjusting the frequencies, and the drop velocity can be controlled by changing the wave amplitude. Furthermore, one or two imaging devices 56, 58 may be used to generate an image of the stent 16 to be used to direct the droplets to selected areas of the stent 16.

Figure 6:
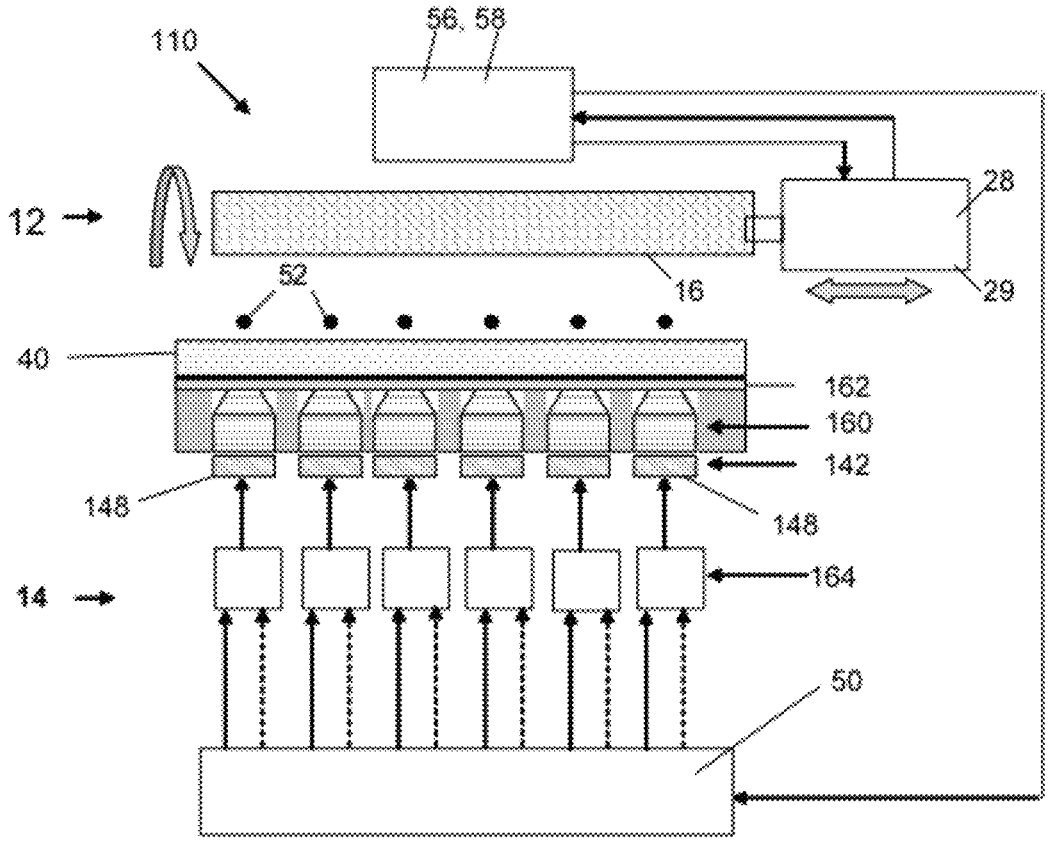
FIG. 6 is a schematic diagram of external transducer arrays containing a single reservoir.

Although the transducer assemblies 42 of the above-described embodiments are placed inside the reservoir 40 and submerged in a coating substance during operation, it is possible to place a transducer assembly outside of a reservoir. FIG. 6 illustrates a stent coating apparatus 110 that includes a reservoir 40 and a transducer assembly 142 that is placed outside of the reservoir 40. In some embodiments, it may be preferable to place only some, but not all, of the transducers of the transducer assembly outside of the reservoir. The stent coating apparatus 110 may further include an acoustic lens 160 placed preferably between each transducer 148 and the reservoir 40. Each acoustic lens 160 may have any suitable configuration, such as a concave configuration. The acoustic lenses 160 may be in direct contact with the coating substance or indirectly in contact with the coating substance through a coupling fluid 162 (external to the solution reservoir). The transducer assembly 142 may include (or may be coupled to) drive electronics, such as an ejection control 50, an RF amplifier, RF switches, and RF drives 164.

Figure 7:
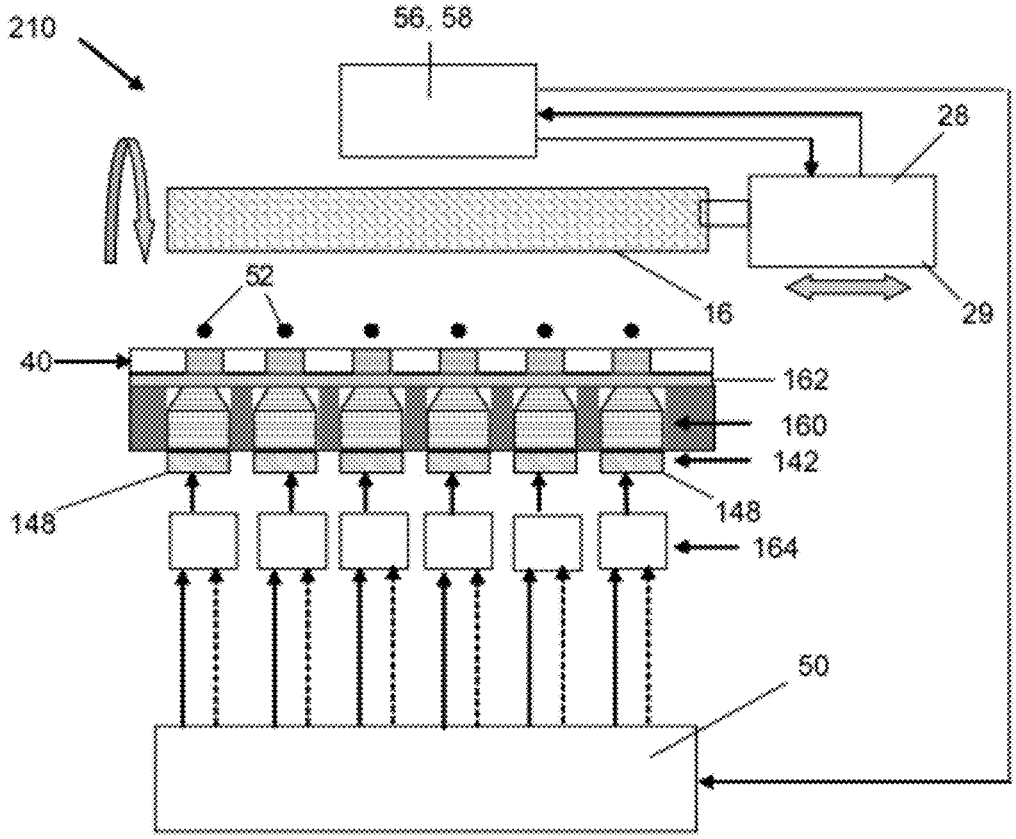
FIG. 7 is a schematic diagram of external transducer arrays containing multiple individual reservoirs.

Furthermore, although the embodiment shown in FIG. 6 has only one reservoir 40, one or more additional reservoirs may be added, and each reservoir may have one or more transducers. In the embodiment 210 shown in FIG. 7, for example, there is a reservoir 240 for each transducer 148.

The present invention offers many advantages over the prior art. For example, the present invention has the ability of coating stent abluminal surface only. A controlled volume of drops are generated and precisely delivered to the selective stent struts, thus it provides a better therapeutic control and it avoids the coating defects that are occurred in spraying and dipping methods. Additionally, the coating speed can be significantly increased through the transducer arrays design that enables coating the stent at multiple locations at a time. Furthermore, the present invention utilizes a nozzleless coating apparatus, thereby it eliminates the nozzle clogging issue which is a common issue to many conventional coating methods.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. An apparatus for coating a stent, the apparatus comprising:

a reservoir configured to carry a coating solution;

a stent support configured to carry a stent adjacent the reservoir;

a plurality of transducers coupled to the reservoir, each transducer configured to generate an acoustic wave through the coating solution to be carried in the reservoir; and a controller configured to power a first subset of transducers from among the plurality of transducers so that the transducers of the first subset collectively eject a first droplet of the coating solution from a first ejection point on a surface of the coating solution, wherein the controller is configured to power the first subset of transducers so that acoustic waves from the first subset of transducers are in-phase with each other at the first ejection point and configured to power a second subset of transducers from among the plurality of transducers so that the transducers of the second subset collectively eject a second droplet from a second ejection point on the surface of the coating solution, the second ejection point being different in location from the first ejection point.

2. The apparatus of claim 1, wherein the controller is configured to power the second subset of transducers to eject the second droplet after the first subset of transducers is powered to eject the first droplet.

3. The apparatus of claim 1, wherein the first subset of transducers includes a transducer that is part of the second subset of transducers and a transducer that is not part of the second subset of the transducers.

4. The apparatus of claim 1, wherein the total number of transducers in the first subset of transducers differs from the total number of transducers in the second subset of transducers.

5. The apparatus of claim 1, wherein the controller is configured to power the first subset of transducers at different times so that the acoustic waves from the first subset of transducers are in-phase with each other at the first ejection point.

6. The apparatus of claim 1, wherein the controller is configured to power the second subset of transducers so that the acoustic waves from the second subset of transducers are in-phase with each other at the second ejection point.

7. The apparatus of claim 1, wherein the stent support has a first end portion configured to support an end of the stent and a second end portion configured to support another end of the stent, and the reservoir is configured to carry the coating solution such that the surface of the coating solution has a longitudinal length that encompasses a longitudinal distance separating the first end portion from the second end portion.

8. The apparatus of claim 1, further comprising:

a second reservoir adjacent the stent support, the second reservoir configured to carry a second coating solution; and a second plurality of transducers coupled to the second reservoir, each transducer among the second plurality of transducers configured to generate an acoustic wave through the second coating solution to be carried in the second reservoir, wherein the controller is in communication with the second plurality of transducers, and the controller is configured to power transducers of the second plurality of transducers to eject a droplet of the second coating solution from an ejection point on a surface of the second coating solution.

9. The apparatus of claim 1, wherein the transducers of first subset of transducers are arranged symmetrically about the first ejection point, and the transducers of the second subset of transducers are arranged symmetrically about the second ejection point.

10. The apparatus of claim 1, wherein the controller is configured to control the plurality of transducers so that droplet ejection occurs in a linear fashion on a stent carried on the stent support.

11. The apparatus of claim 1, wherein the controller is configured to control the plurality of transducers so that the first ejection point and the second ejection point are aligned to a longitudinal direction of a stent carried on the stent support.

* * * * *